US007967291B1

(12) United States Patent
Ayala et al.

(10) Patent No.: US 7,967,291 B1
(45) Date of Patent: Jun. 28, 2011

(54) DETENT TO PREVENT JAMMING OF A DOCUMENT SORTING MACHINE

(75) Inventors: Federico Ayala, Grand Prairie, TX (US); Brent A. Daboub, Frisco, TX (US)

(73) Assignee: National Presort, Inc., Dallas, TX (US)

( * ) Notice: Subject to any disclaimer, the term of this patent is extended or adjusted under 35 U.S.C. 154(b) by 1260 days.

(21) Appl. No.: 11/189,380

(22) Filed: Jul. 26, 2005

(51) Int. Cl.
*B65H 39/10* (2006.01)

(52) U.S. Cl. ..... 271/305; 271/220; 271/297; 271/298; 271/303

(58) Field of Classification Search ..... 271/297, 271/298, 303, 305, 220
See application file for complete search history.

(56) References Cited

U.S. PATENT DOCUMENTS 3,315,955 A * 4/1967 Schaller ..... 271/298
4,141,546 A * 2/1979 Queener ..... 271/288
4,162,733 A * 7/1979 Wiseman ..... 414/790.4
4,718,660 A * 1/1988 Daboub ..... 271/305
4,789,149 A * 12/1988 Ray et al. ..... 271/215
5,109,987 A * 5/1992 Daboub et al. ..... 209/657
5,150,894 A * 9/1992 Ricciardi ..... 271/302
5,166,740 A * 11/1992 Tanahashi et al. ..... 399/373
RE34,330 E * 8/1993 Daboub ..... 271/305
5,417,414 A * 5/1995 Belec et al. ..... 271/178
5,419,545 A * 5/1995 Hutson ..... 271/222
5,575,464 A * 11/1996 Martinez et al. ..... 271/2
5,971,161 A * 10/1999 Branecky et al. ..... 209/657
6,481,712 B1 * 11/2002 Yap ..... 271/303
6,902,162 B2 * 6/2005 Otto et al. ..... 271/207
2003/0080503 A1 * 5/2003 Wright et al. ..... 271/303

* cited by examiner

*Primary Examiner* — Gerald W McClain
(74) *Attorney, Agent, or Firm* — Drude Faulconer

(57) ABSTRACT

A document sorting machine having at least one pocket for stacking documents according to a common criteria. Each pocket has a gate for diverting the document from the transport of the machine and into the designated pocket. The pocket also has a kicker for moving the tail of the document away from the pocket's entry and into the pocket and a detent which allows the tail to be moved into the pocket but which prevents the tail from moving back towards the pocket's entry after the tail of the document has been moved into the pocket.

4 Claims, 3 Drawing Sheets

DETENT TO PREVENT JAMMING OF A DOCUMENT SORTING MACHINE

TECHNICAL FIELD

The present invention relates to a machine used for sorting documents, e.g. mail, and more particularly relates to a means for retaining the tail of a document away from the entry of a stacker pocket of a document sorting machine once the document has entered the pocket so that the next document to be stacked in that pocket can easily enter the pocket without jamming.

BACKGROUND OF THE INVENTION

For several years, automated "sort machines" have been available which sort large volumes of documents (e.g. letters, postcards, checks, flats, and the like) into groups having a common identifying criteria (e.g. Zip Codes, mail boxes, etc.). A sort machine is typically comprised a "front end" or feed section and one or more "stacker sections". The front end feeds the pieces, one-by-one, past a reader (e.g. optical character reader ("OCR"), bar code reader ("BCR"), or the like) and onto a transport that carries it to a designated sort pocket in the stacker section(s).

As the piece passes the reader, the desired criteria on a piece is read and a signal is generated that, in turn, is processed to generate a designation signal for that particular piece. This designation signal, in turn, triggers a diverter or "gate" at the designated pocket in the stacker section as the piece approaches to divert the piece from the transport into the designated pocket where it is stacked with other pieces having the same identifying criteria. Such machines are well known and are commercially-available, e.g. Vsort™ Flat Sort Machine, OMEGA™ Sort Machine, both manufactured and distributed by National Presort, Inc., Dallas, Tex.

One problem that exists in such machines arises from the occasional jamming of pieces as they are diverted into their designated pockets. One major cause of this jamming is that the "tail" of a previously diverted piece is not sufficiently moved away from gate (i.e. pocket entry) and into the pocket so that it may interfere with the leading edge of the next piece diverted into that same pocket. That is, if the tail of the last piece in a particular pocket is not moved sufficiently into the pocket and away from the gate, the leading edge of the next piece can be driven into the tail of the last piece thereby causing a "jam".

One highly successful "fix" in alleviating jamming in machines of this type is to provide a "kicker" at each pocket which aligns with the gate of that pocket when the gate is actuated to divert a piece into the pocket. This allows smooth entry of the piece from the transport into the pocket. Once the piece has cleared the pocket's entry, the kicker is moved to "kick" the tail of that piece inwardly into the pocket and away from the entry point into the pocket. This allows the next piece to smoothly enter the pocket without engaging the tail of the previous piece. For complete details of such an anti-jamming means, i.e. "kicker", see U.S. Pat. Re. 34,330, which is incorporated herein in its entirety by reference.

While this kicker works extremely well in preventing jamming in most instances (even with a wide variety of different types of mail pieces), there are some instances where the possibility of jamming still exists. For example, if the pieces are too stiff (e.g. glossy brochures) or too flimsy (e.g. tissue paper-like pieces), the tails of these pieces may not stay in the "kicked" position but may have a tendency to return toward the entry of the pocket once the kicker returns to its original position. Hence, the tail of the last sorted piece will be exposed for possible contact with the next piece entering that pocket and jamming can occur. Since the commercial market for this type of sort machines is highly competitive, any improvement in preventing jams may be significant in selling the machines since the downtime required for clearing jams is a major consideration when selecting the machine.

SUMMARY OF THE INVENTION

The present invention provides a document sorting machine having at least one pocket for stacking documents according to a common criteria. Each pocket has a means for diverting the document from the transport of the machine and into the designated pocket. The pocket also has a means for moving the tail of the document away from the entry into the pocket and completely into the pocket and a detent means for preventing the tail from moving back towards the pocket entry after the tail of the document has been moved completely into the pocket.

More specifically, the present invention provides a pocket for a document sorting machine wherein the pocket is comprised of a base plate having a means (e.g. a gate) thereon for diverting a document from the machine's transport and into the pocket. The pocket includes a means (e.g. a kicker) on said base plate for moving the tail of the document away from the pocket's entry and completely into the pocket In accordance with the present invention, a detent means is provided on the base plate for preventing the tail of the document from moving back towards the entry after the tail has been moved or kicked into the pocket. This prevents the tail of the sorted document from interfering with the leading edge of the next document diverted into the same pocket, thereby alleviating the possibility of the "jamming" of the documents.

Basically, the detent means is comprised of a detent which is movably mounted within an opening which, in turn, is formed through the base plate at a point inwardly from the pocket's entry. The detent, when in a first position, extends above the base plate to thereby prevent the tail of said document from moving back towards pocket's entry and, when in a second position, allows the tail to be kicked away from the entry and into the pocket. A means biases the detent towards its first position so that the detent will normally extend above the upper surface of the base plate to thereby present a barrier against the return of the tail towards the pocket's entry.

More specifically, the detent is comprised of a bent L-shaped member which is rotatably mounted within the opening in said base plate. The bent L-shaped member, when in its first position, has one leg extending substantially downward through the opening in the base plate and has another leg bent at a angle and extending above said base plate to provide a cam surface facing towards the pocket's entry. This cam surface and/or the depression of the member into the base plate allows the kicker to move the tail of the document over the detent and into the pocket. The means for biasing the member to its first position is preferably a small mass suspended by a chain or the like from the downwardly extending leg of the member but can equally be comprised of spring(s) appropriately positioned between the member and the base plate.

BRIEF DESCRIPTION OF THE DRAWINGS

The actual construction operation, and apparent advantages of the present invention will be better understood by referring to the drawings, not necessarily to scale, in which like numerals identify like parts and in which.

While the invention will be described in connection with its preferred embodiments, it will be understood that this invention is not limited thereto. On the contrary, the invention is intended to cover all alternatives, modifications, and equivalents that may be included within the spirit and scope of the invention, as defined by the appended claims.

DESCRIPTION OF THE PREFERRED EMBODIMENTS

Figure 1:
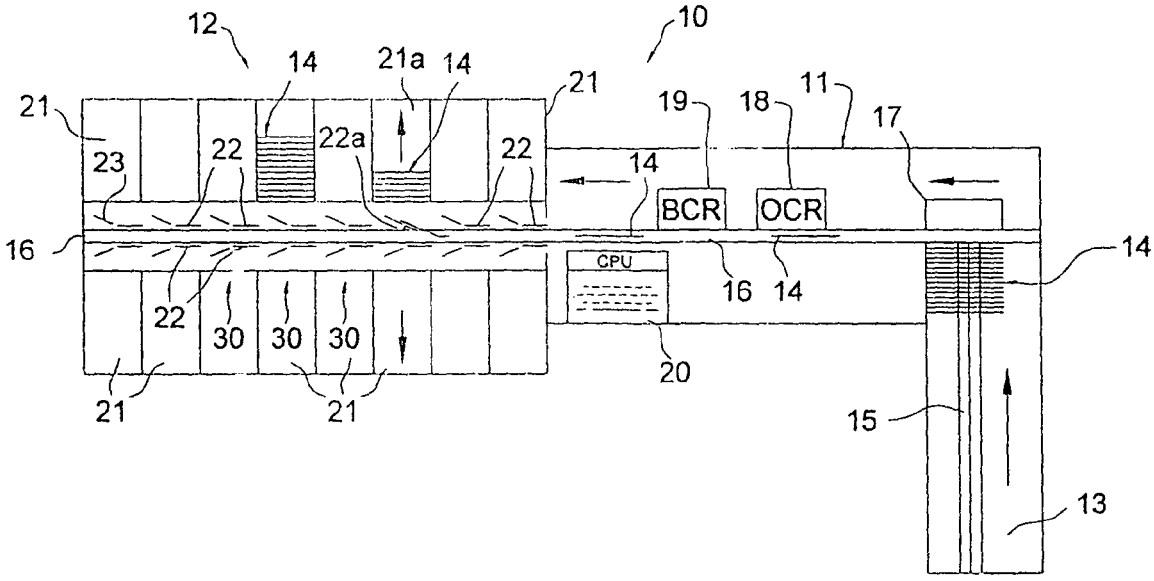
FIG. 1 is an idealized top view of a typical sort machine into which the present invention can be incorporated.

Referring more particularly to the drawings, FIG. 1 is a plan view of a typical document sort machine 10 of the type into which the present invention can easily be incorporated. Machine 10 is comprised of a feeder section 11 and a stacker section 12. The feeder section 11 is comprised of a magazine 13 onto which a batch of documents (e.g. letters or pieces 14) are positioned. Conveyor 15 (e.g. motor driven chain-link belts) feeds document 14 forward onto pickoff 17 which picks off one piece at a time and delivers it onto transport 16. As the document passes by optical character reader 18 and/or bar code reader 19, an identifying mark, (e.g. a sort code such as a Zip Code or bar code, respectively) on the document 14 is read by the appropriate reader which, in turn, generates a signal representative of the mark. These signals are then processed in unit 20 which outputs a designation signal to stacker section 12.

While stacker section 12 is shown as being comprised of a plurality, horizontal stacker bins or "pockets" 21 arranged in pairs having one pocket on either side of the transport 16*a*, it should be understood, that as far as the present invention is concerned, the layout of the pockets, themselves, can take other configurations. For example, the pockets can be aligned on only one side of the transport in a single row or a plurality of single rows can be vertically spaced one above the others in a multi-level machine, see U.S. Pat. No. 5,109,987, issued May 5, 1992 and which is incorporated in its entirety by reference.

Figure 4:
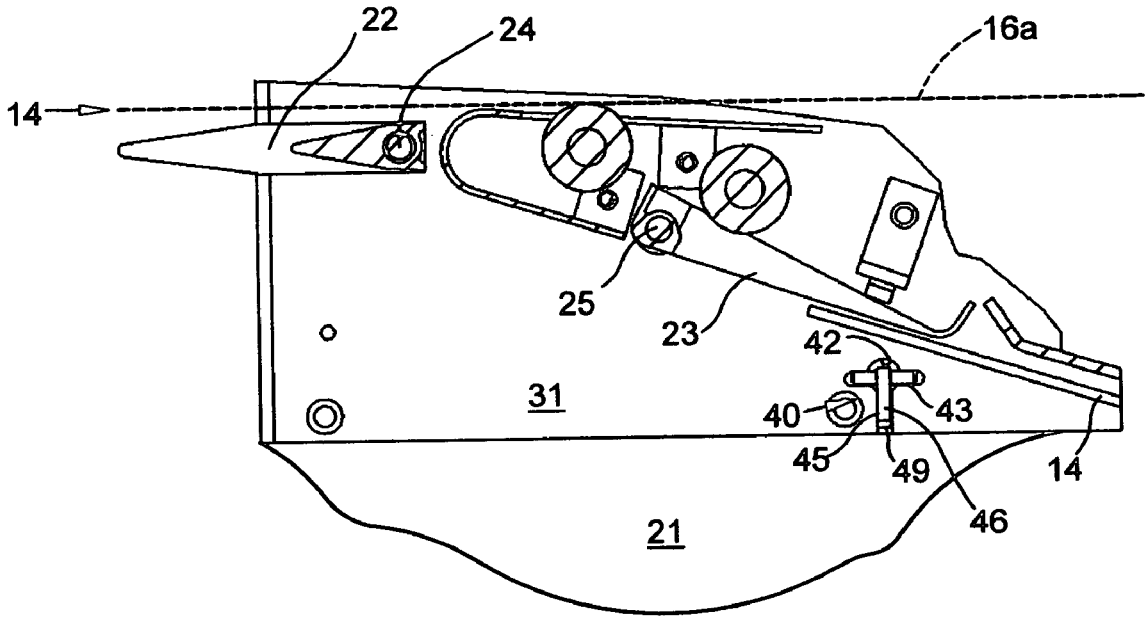
FIG. 4 is an enlarged, sectional top view of the pocket module of FIG. 2, partly broken away, when the gate and kicker are in their original positions.

Each pocket 21 has a diverter means (i.e. gate 22, only some of which are numbered in FIG. 1 for clarity) which is actuated by the designation signal from processing unit 20 as a designated document 14 approaches its pocket. Gate 22, when activated, rotates to temporarily intersect the centerline of transport 16 (FIGS. 1, 4, and 5), to thereby divert document 14 from transport 16 into the designated pocket 21*a*. The construction and operation of sort machine 10 as described up to this point is well known, e.g. Models NP8000, Vsort™ and OMEGA™ Mail Sorters, manufactured and distributed by National Presort, Inc., Dallas, Tex.

Turning now to FIGS. 2-5, a single pocket module 30 incorporating the anti-jamming means of the present invention is described in detail. While the module 30 is illustrated as a single pocket module, again it should be recognized that the present invention is equally adaptable for use with a module having two opposed pockets (FIG. 1) or in machines wherein the pockets, themselves, are formed integrally on the deck of the stacker section, as is the case in some older sort machines.

As shown in FIGS. 2-5, module 30 is comprised of base plate 31 on which a gate 22 and a kicker 23 are rotatably mounted. In its original position, gate 22 lies parallel to transport 16 so that any document 14 not designated to be sorted into the pocket adjacent module 30 will pass on by gate 22 and continue on transport 16 until it reaches a downstream destination. As will be understood in this art, transport 16 is typically comprised of a series of driven belts mounted on spaced pulleys or the like (not shown) which provide the "pinch" necessary for a document to be transported through module 30 to the next adjacent module if the document is not to be diverted to a pocket controlled by that particular module.

Further, as will be understood by those skilled in this art, each individual module 30 will control the diversion of documents into an adjacent pocket 21 (FIGS. 1, 4, and 5) by the actuation of the respective proper gate 22. Each gate 22 is affixed to the upper end of a shaft 24 which, in turn, is rotated by an individual rotational solenoid (not shown) which is preferably of the type that rotates in one direction against the bias of an internal spring when actuated and which is rotated in the other direction by the spring force when deactuated. An example of such a solenoid is Model 188131-001 (Right-hand or Left-hand), manufactured by Ledex, Inc., Vandalia, Ohio.

Figure 5:
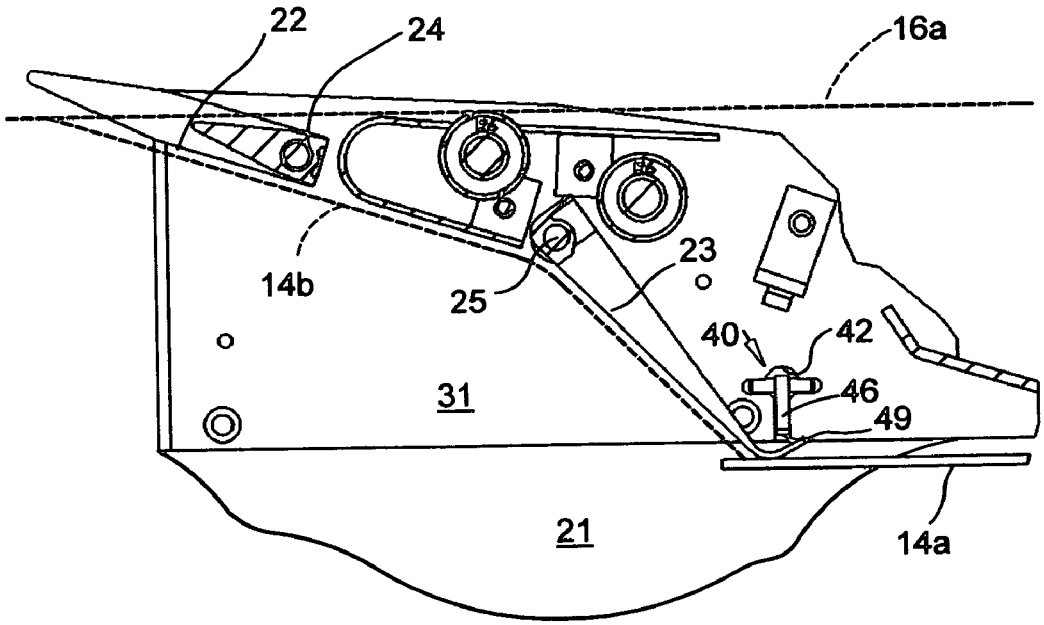
FIG. 5 is a enlarged, section top view similar to FIG. 4 when both the gate and kicker of the module have been actuated to a second position.

Gate 22, when in a first position (FIG. 4), lies substantially parallel to the centerline of transport 16 (dotted line 16*a* in FIG. 4) and intersects the centerline when a second position (FIG. 5). Kicker gate 23 (only one numbered in FIG. 1) which may have substantially the same configuration as gate 22 is provided for each module 30 and is mounted on the upper end of a shaft 25 of a rotational solenoid (not shown) which is of the same type as the previously described solenoid. When in a first position (FIG. 4), kicker 23 is positioned so as to be basically aligned with gate 22 when gate 22 diverts a document into its pocket so that the document will move smoothly into the pocket. When kicker 23 is rotated, the kicker "kicks" the tail 14*a* (FIG. 5) firmly into the pocket 21 and away from the entry of the pocket. The construction and the operation of module 30 up to this point is basically the same as that disclosed and claimed in U.S. Pat. Re 34,330 which, in turn, is incorporated herein in its entirety by reference.

While the kicker described above has proved highly successful in reducing jamming caused by the forward edge of an incoming document contacting the tail of a previously sorted document, unfortunately, the possibly of jamming still exists in isolated instances. That is, with certain types of documents, the tail of the document may not remain in its "kicked" position but instead may try to return towards the entry of the pocket as the kicker returns to its original position.

Figure 3:
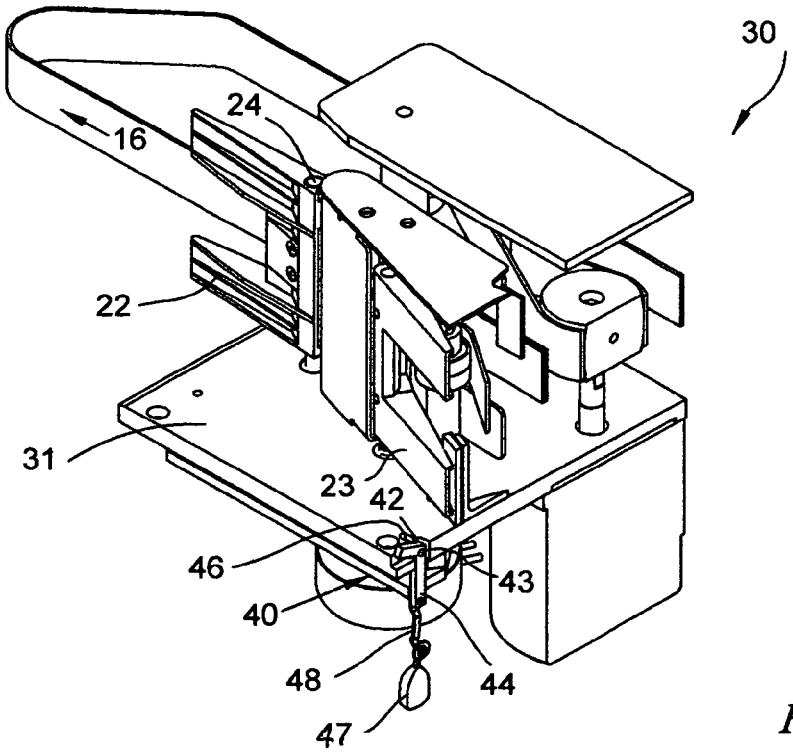
FIG. 3 is a perspective view of the pocket module as shown in FIG. 2, partly broken away, to better show the details of the detent.

In accordance with the present invention, a biased detent 40 is provided at the front of pocket 21 which allows the tail of a document to be "kicked" fully into the pocket but prevents the tail from following the kicker back towards the entry of the pocket. More specifically, as best seen in FIG. 3. a detent 40 is positioned through opening 42 in base plate 21 of module 30 and is pivotably mounted therein on an axis pin 43 or the like. Detent 40, as shown, is comprised of an bent L-shaped member having one leg 44 which extends substantially vertically downward through opening 43 with the other leg 45 defining a cam surface 46 which extends above the surface of the base plate at an angle (e.g. 20°) and slopes upwardly away from the transport 16 when the detent is in its normal operating position.

Figure 2:
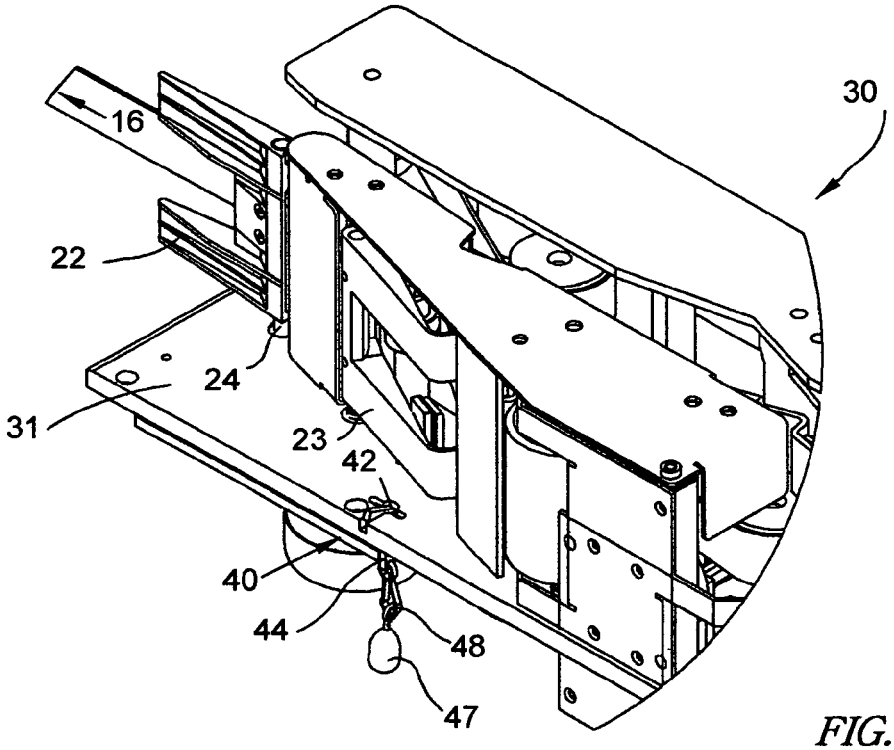
FIG. 2 is a perspective view of a pocket module which can be used in the typical sort machine shown in FIG. 1 and which includes the detent of the present invention.

In the preferred embodiment shown in FIGS. 2 and 3, a small mass 47 (e.g. 1 oz.) is suspended from the bottom of leg 44 by a short length of chain 48 or the like. The weight of mass 47 is such as to allow contact of the tail 14*a* (FIG. 5) of the incoming document to easily cam up over surface 46 of leg 45 and/or rotate leg 45 downward into base plate 31 (depending on the document being sorted) thereby allowing the tail of the document to be moved into the pocket and away from the point of entry.

Figure 6:
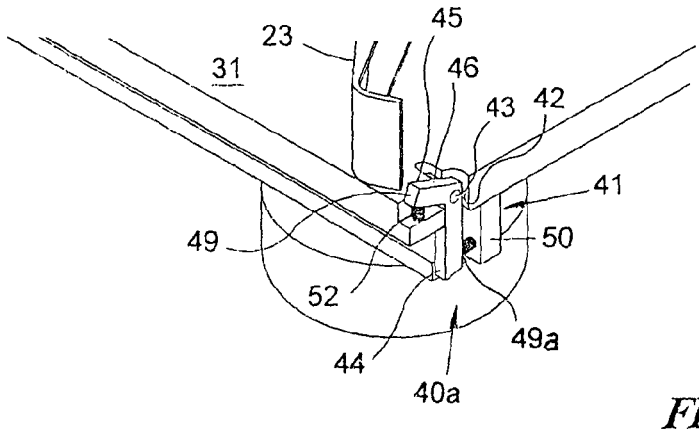
FIG. 6 is a partial view of the module of FIG. 2 illustrating another embodiment of the detent of the present invention.

While mass 47 is simple and easily maintained, it should be recognized that other biasing means can be used to bias detent 40 towards its normal operation position. For example, FIG. 6 discloses an embodiment where springs are used for this purpose. Detent 40*a* is comprised of a bent L-shaped member (same as before) which has a compression spring 49*a* positioned between the long leg 44 and a vertical support 50 on base plate 31. Likewise, a second compression spring 52 can be placed between the angled leg 45 and the base plate. Only one of these springs may be required or both can be used if desired. Other biasing arrangements will suggest themselves to those skilled in this art without departing from the present invention.

In operation, a document 14 is sorted by front end 11 and is sent down transport 16. When it approaches its designated pocket, gate 22 is actuated to intersect the centerline of transport 14 (FIG. 5) to divert the document into its pocket. As the document follows path (dotted lines 14*b*, FIG. 5), kicker 23 is actuated to "kick" the tail 14*a* of the piece positively into the pocket and away from the point of entry into the pocket. As the tail 14*a* is moved by kicker 23, it contacts the cam surface 46 of detent 40 and causes bent the L-shaped member to rotate about pin 43. This effectively depresses the angled leg 45 of the bent-L member until it is level with the base plate.

As detent 40 rotates, mass 47 will be inherently lifted. Once the document clears the depressed leg 45, gravity pulls mass 47 downward to thereby detent 40 back to its original position. Now if the tail 14*a* attempts to return towards its original position along with kicker 23, it abuts the substantially vertical surface 49 of leg 45 (FIGS. 4 and 5) which, in turn, blocks the tail 14*a* from moving back towards the pocket's entry. In this position, detent 40 is again in position to receive the next incoming document and the operation can be repeated without interruption. This insures that the tail of a previously sorted document will not interfere with the leading edge of the next incoming document to that pocket and the possibility of "jamming" is significantly reduced, if not eliminated.

What is claimed is:

1. A document sorting machine having a transport and at least one pocket module for stacking documents wherein each document has a leading edge and a tail, said pocket module comprising:

a base plate;

a gate mounted on said base plate having a first position which allows a document to continue along said transport and a second position which intersects said transport to divert a document from said transport into an entry of a pocket adjacent said base plate, said pocket adapted to receive said documents;

a kicker mounted on said base plate downstream of said gate, said kicker (a) having a first position which allows said document to enter said pocket and (b) being movable to a second position to kick said tail of said document away from said entry and into said pocket; and detent means on said base plate for preventing said tail of said document from moving back towards said entry after said tail of said document has been moved into said pocket; said detent means comprising:

an opening through said base plate positioned downstream from said entry;

a detent movably mounted within said opening, said detent having a first position wherein it extends above said base plate to thereby prevent said tail of said document from moving back towards said entry and a second position wherein said tail is allowed to move away from said entry and into said pocket; and means for biasing said detent towards its said first position.

2. The document sorting machine of claim 1 wherein said detent comprises:

a bent L-shaped member rotatably mounted on said base plate, said member, when in said first position, having a first leg extending substantially downward through said opening in said base plate and a second leg bent at an angle and extending above said base plate to provide a cam surface facing said entry; and means for biasing said member towards said first position.

3. The document sorting machine of claim 2 wherein said means for biasing said member comprises:

a mass connected to said first leg of said member and extending downward from said base plate, said mass having a weight sufficient to (a) allow rotation of said member upon contact of said tail with said second leg of said member as said tail is being moved into said pocket and (b) return said member to said first position when no longer in contact with said tail to thereby allow said second leg to prevent said tail from returning towards said entry.

4. The document sorting machine of claim 2 wherein said means for biasing said member comprises:

a spring positioned between said base plate and one of said legs of said member to thereby bias said member to said first position.

* * * * *